US011033053B2

(12) United States Patent
Courbat et al.

(10) Patent No.: US 11,033,053 B2
(45) Date of Patent: Jun. 15, 2021

(54) AEROSOL-GENERATING SYSTEM AND METHOD FOR CONTROLLING THE SAME

(71) Applicant: Philip Morris Products S.A., Neuchatel (CH)

(72) Inventors: Jerome Christian Courbat, Neuchatel (CH); Oleg Mironov, Neuchatel (CH); Ihar Nikolaevich Zinovik, Peseux (CH)

(73) Assignee: Philip Morris Products S.A., Neuchatel (CH)

( * ) Notice: Subject to any disclaimer, the term of this patent is extended or adjusted under 35 U.S.C. 154(b) by 254 days.

(21) Appl. No.: 16/328,406

(22) PCT Filed: Sep. 13, 2017

(86) PCT No.: PCT/EP2017/073035
§ 371 (c)(1),
(2) Date: Feb. 26, 2019

(87) PCT Pub. No.: WO2018/050701
PCT Pub. Date: Mar. 22, 2018

(65) Prior Publication Data

US 2019/0191783 A1 Jun. 27, 2019

(30) Foreign Application Priority Data

Sep. 14, 2016 (EP) ..... 16188809

(51) Int. Cl.
*A24F 47/00* (2020.01)
*A24F 40/53* (2020.01)
(Continued)

(52) U.S. Cl.
CPC ..... *A24F 40/53* (2020.01); *A24D 1/20* (2020.01); *A24F 40/40* (2020.01); *A24D 1/02* (2013.01); *A24F 40/20* (2020.01)

(58) Field of Classification Search
CPC ..... A24F 40/50; A24F 40/57; A24F 47/008
See application file for complete search history.

(56) References Cited

U.S. PATENT DOCUMENTS

2010/0163063 A1 7/2010 Fernando et al.
2014/0196736 A1 7/2014 Fernando et al.
(Continued)

FOREIGN PATENT DOCUMENTS

CN 1064945 A 9/1992
CN 101140668 A 3/2008
(Continued)

OTHER PUBLICATIONS

Office Action dated Aug. 26, 2020 in corresponding Korean Patent Application No. 10-2019-7004693 (with English Translation), 11 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating system is provided, including an aerosol-generating article including at least one component incorporating an aerosol-forming substrate; a luminescent material having a temperature-dependent phosphorescence characteristic; a heater configured to heat the luminescent material and the at least one component; and an aerosol-generating device including a support configured to at least partially receive the aerosol-generating article, a light source configured to illuminate and to excite the luminescent material, a detector configured to detect a temperature-dependent phosphorescence characteristic of the excited luminescent material, and electrical hardware configured to control heat-
(Continued)

ing by the heater based on the detected characteristic. A method for controlling the aerosol-generating system is also provided.

15 Claims, 4 Drawing Sheets

(51) Int. Cl.

| | |
|---|---|
| ***A24D 1/20*** | (2020.01) |
| ***A24F 40/40*** | (2020.01) |
| *A24D 1/02* | (2006.01) |
| *A24F 40/20* | (2020.01) |

(56) References Cited

U.S. PATENT DOCUMENTS

| | | | | |
|---|---|---|---|---|
| 2015/0181932 | A1 | 7/2015 | Heath | |
| 2015/0185160 | A1* | 7/2015 | Lacoste ..... | B65D 41/00 356/398 |
| 2016/0302488 | A1 | 10/2016 | Fernando et al. | |
| 2016/0374402 | A1 | 12/2016 | Fernando et al. | |
| 2017/0055589 | A1 | 3/2017 | Fernando et al. | |

FOREIGN PATENT DOCUMENTS

| | | | |
|---|---|---|---|
| CN | 102264251 | A | 11/2011 |
| CN | 102551217 | A | 7/2012 |
| CN | 104160266 | A | 11/2014 |
| CN | 105209890 | A | 12/2015 |
| CN | 105764366 | A | 7/2016 |
| CN | 105919156 | A | 9/2016 |
| JP | 2009-148233 | A | 7/2009 |
| KR | 10-2013-0095274 | A | 8/2013 |
| WO | 2011/065754 | A2 | 6/2011 |
| WO | WO 2012/018915 | A2 | 2/2012 |
| WO | WO 2015/082560 | A1 | 6/2015 |
| WO | WO 2016/096927 | A1 | 6/2016 |

OTHER PUBLICATIONS

International Search Report dated Nov. 27, 2017 in PCT/EP2017/073035 filed on Sep. 13, 2017.

Written Opinion of the International Searching Authority dated Nov. 27, 2017 in PCT/EP2017/073035 filed on Sep. 13, 2017.

Extended European Search Report dated Mar. 13, 2017 in EP16188809.4 filed on Sep. 14, 2016.

Chinese Office Action dated Jan. 11, 2021 in corresponding Chinese Patent Application No. 201780055174.X (with English translation), 21 pages.

* cited by examiner

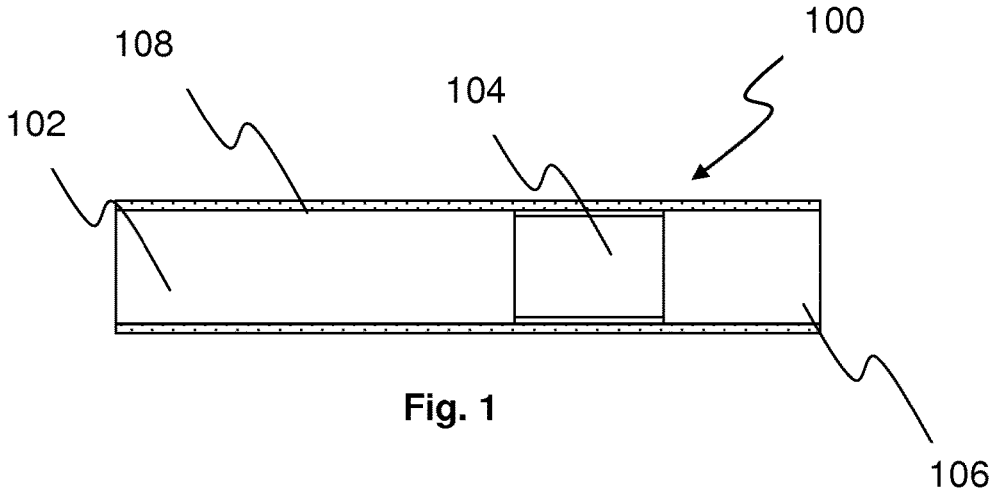
Fig. 1
Fig. 2
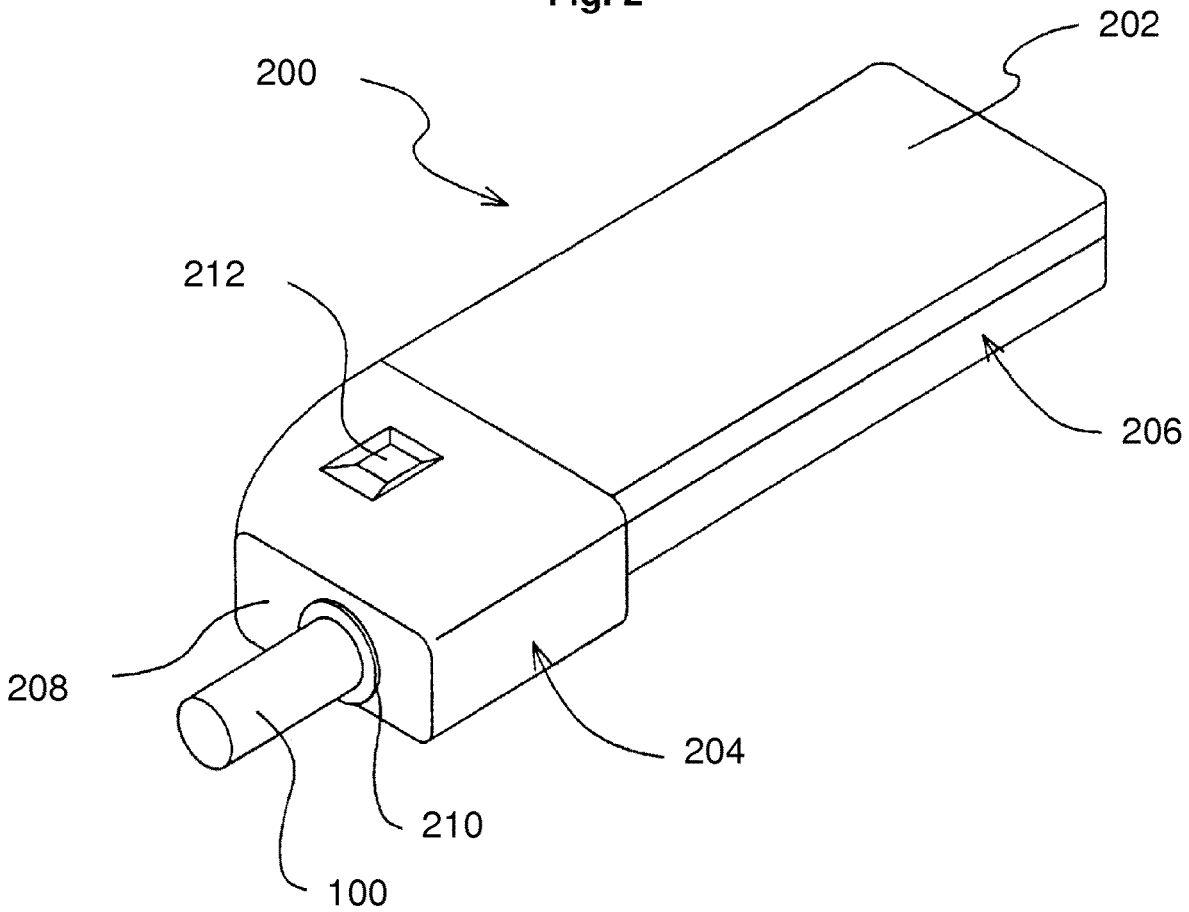

AEROSOL-GENERATING SYSTEM AND METHOD FOR CONTROLLING THE SAME

The invention relates to an aerosol-generating system and a method for controlling the aerosol-generating system. In particular, the invention relates to handheld aerosol-generating systems, such as electrically operated smoking systems.

Known aerosol-generating systems comprise an aerosol-generating device and an aerosol-generating article incorporating an aerosol-forming substrate. The aerosol-generating device is adapted to receive the aerosol-generating article and to apply heat to the aerosol-forming substrate by a heater. By heating the aerosol-forming substrate, an aerosol is generated which can e.g. be inhaled by a user of the aerosol-generating system.

Undesired charring, burning and combustion of parts of the aerosol-generating article, in particular of the aerosol-forming substrate, may result in creation of undesirable inhalation constituents. Thus, overheating of the aerosol-forming substrate must be avoided. Therefore, precise temperature detection and temperature control of the heated aerosol-forming substrate are required. Various techniques are known for detecting the temperature of the aerosol-forming substrate. A contact-based class of techniques is based on detecting the current temperature of the aerosol-forming substrate being in physical contact with a temperature sensor, such as an electric resistor. A contactless class of techniques employs a temperature sensor which is not in physical contact with the aerosol-forming substrate, such as an infrared detector for detecting heat radiation. Precision of contact-based temperature detection depends on variable and unpredictable contact conditions between a temperature sensor and the aerosol-forming substrate. Therefore, contactless temperature detection is favorable for aerosol-generating systems intended for use with replaceable aerosol-generating articles. However, precision of contactless temperature detection depends on the correct alignment of the heat radiation sensor to the aerosol-forming substrate. Precision may suffer if the heat radiation sensor is misaligned e.g. erroneously measuring the temperature of a surface of the heater which is different from the temperature of the aerosol-forming substrate to be measured.

It would be desirable to provide an aerosol-generating system and a method for controlling an aerosol-generating system that provide improved and reliable temperature detection and temperature control of a heated aerosol-forming substrate.

For addressing at least one of these desires, according to a first aspect of the present invention, an aerosol-generating system comprising an aerosol-generating article, a luminescent material, a heater, and an aerosol-generating device is presented. The aerosol-generating article includes at least one component incorporating an aerosol-forming substrate. The aerosol-generating device comprises a support for at least partially receiving the aerosol-generating article. The support may be configured as a cavity. The heater of the aerosol-generating system is arranged and adapted for heating the luminescent material and the at least one component incorporating the aerosol-forming substrate. Furthermore, the aerosol-generating device comprises a light source for illuminating and exciting the luminescent material. The aerosol-generating device also comprises a detector for detecting a temperature-dependent phosphorescence characteristic of the excited luminescent material. Moreover, the aerosol-generating device comprises an electrical hardware which is configured to control heating by the heater based on the detected phosphorescence characteristic of the excited luminescent material.

The luminescent material may be part of the aerosol-generating article, or the luminescent material may be part of the aerosol-generating device, or the luminescent material may be a separate component of the aerosol-generating system. The heater may be part of the aerosol-generating article, or the heater may be part of the aerosol-generating device, or the heater may be a separate component of the aerosol-generating system. Preferably, the heater is part of the aerosol-generating device and the luminescent material is part of the aerosol-generating article, or the luminescent material is part of the aerosol-generating device, or the luminescent material is a separate component of the aerosol-generating system.

The aerosol-forming substrate and the luminescent material are arranged such to each other that a current temperature of the aerosol-forming substrate can be precisely derived from the temperature of the luminescent material. The temperature of the luminescent material is determined by detecting its temperature-dependent phosphorescence characteristic. To this end, the luminescent material may be, preferably homogeneously, distributed throughout the aerosol-forming substrate. The luminescent material may be additionally or alternatively distributed on an outer surface of the aerosol-forming substrate or on an outer surface of the at least one component. The luminescent material may be incorporated into any component of the aerosol-generating article, including but not limited to: paper, such as wrapper paper; filters; tipping papers; tobacco; tobacco wraps; coatings; binders; fixations; glues; inks, foams, hollow acetate tubes; wraps; and lacquers. The luminescent material may be incorporated into the at least one component by either adding it during the manufacture of the material, for example by adding it to a paper slurry or paste before drying, or by painting or spraying it onto the at least one component. Typically, the luminescent material is incorporated into the component in trace, nano-gram, quantities. For example, where the luminescent material is sprayed on the surface, the solution being sprayed may incorporate the luminescent material in a concentration of between 1 ppm and 1000 ppm. Preferably, the luminescent material is disposed where the highest temperature of the aerosol-forming substrate occurs during operation of the heater. Alternatively or optionally to incorporating the luminescent material in the aerosol-generating article as mentioned above, the luminescent material may be disposed within the aerosol-generating device.

Preferably, the luminescent material is sufficiently chemically stable so as not to decompose during manufacture of the aerosol-forming substrate or of the at least one component. Thus, the luminescent material is preferably stable when it is: exposed to liquid water; exposed to water vapor; exposed to other commonly used solvents; upon drying; upon physical deformation of the material to form the component; upon exposure to increased temperatures; and upon exposure to reduced temperatures.

The material of the at least one component of the aerosol-generating article incorporating the luminescent material may be manufactured by adding the luminescent material as an ingredient in the slurries used to make the material. The slurries may then be formed, for example by casting, and dried to produce the material, such as paper or wrapper material.

The term luminescence as used herein with respect to the luminescent material refers to photoluminescence in general. Photoluminescence includes fluorescence and phosphorescence. A luminescent material being illuminated and excited emits light due to fluorescence. If the excited luminescent material emits light beyond at least 10 nanoseconds after excitation, the luminescent material emits light due to phosphorescence.

This invention is based on detecting a temperature of luminescent material having a phosphorescence property. This luminescent material is excitable by illuminating it by light with an excitation wavelength. Subsequent to the excitation, even without illuminating or exciting the luminescent material, the excited luminescent material emits light with one or more emitting wavelengths, i.e. exhibits an afterglow, due to its phosphorescence property.

The emitting wavelength(s) of the emitted light will be longer than the excitation wavelength(s). The characteristic of the phosphorescence property of the luminescent material, i.e. the phosphorescence characteristic, depends on the current temperature of the luminescent material. The temperature-dependent phosphorescence characteristic may be determined based on any temperature-dependent characteristic inherent to phosphorescent materials. The temperature-dependent phosphorescence characteristic of the luminescent material may be detected based on a temperature-dependent intensity of light emitted by the excited luminescent material. The temperature-dependent phosphorescence characteristic of the luminescent material may be detected based on a temperature-dependent intensity ratio of at least two emitting wavelengths of the excited luminescent material. The temperature-dependent phosphorescence characteristic of the luminescent material may be detected based on a temperature-dependent spectral shift of emitted light, on a temperature-dependent spectral width of emitted light, or on a combination thereof. The temperature-dependent phosphorescence characteristic may be detected based on a temperature-dependent absorption of excitation wavelength(s) by the luminescent material. The temperature-dependent phosphorescence characteristic may be detected based on a rise time of the emitted light until the emitted light reaches a maximum intensity after excitation. The temperature-dependent phosphorescence characteristic may be detected based on a lifetime or luminescence decay rate of the emitted light.

The luminescence decay rate may be detected based on the brightness of the emitted light decreasing over time or the duration of afterglow. When increasing the temperature of the luminescent material, the luminescence decay rate will increase, i.e. the brightness of the emitted light will decrease faster over time and duration of afterglow will decrease. Thus, the detected luminescence decay rate corresponds to the current temperature of the luminescence material. The luminescence decay rate is an inverse equivalent measure to the so called lifetime which is the time for the brightness to decrease to 1/e (e=Euler's number) of its original value. For detecting the temperature-dependent luminescence decay rate it may be sufficient to determine or measure a single value of the property such as for example measuring a brightness value after a predetermined period of time has elapsed since end of excitation. Alternatively, it may for example be sufficient to determine or measure a single value related to the property such as measuring a period of time until the brightness of the emitted light has decreased to a predetermined brightness value. The single value may be related to a known or expected value of the property which may exemplarily represent a known brightness occurring immediately subsequent to the excitation. Alternatively, a plurality of brightness values may be measured in order to determine a current temperature of the luminescent material.

The luminescent material of the aerosol-generating system has a temperature-dependent phosphorescence characteristic which may be identifiable by the detector within a temperature range of up to 2000 degree Celsius. The luminescent material is at least stable within a temperature range extending from low recommended storage temperatures of the aerosol-generating article up to and beyond intended operating temperatures of the heater.

The light source of the aerosol-generating device may be configured for illuminating and exciting the luminescent material intermittently with an excitation light. Alternatively, the light source may be configured for illuminating and exciting the luminescent material continuously with an excitation light of varying intensity or simultaneously with detecting the light emitted by the excited luminescent material. The excitation light may have any arbitrary pulse shape, e.g. a rectangular, sinusoidal, triangular or saw tooth shape. If the light source continuously or simultaneously illuminates and excites the luminescent material, the excitation light should have an amplitude varying over time. The term continuously refers in particular to simultaneously illuminating/exciting the luminescent material and detecting the emitted light. Thus, the term continuously does not exclude an intensity of the illuminating light temporarily being zero, as e.g. for a sinusoidal waveform having a minimum amplitude of zero. For such simultaneous illumination/excitation and light detection, a temperature-dependent phase lag between excitation light and the emitted light of the luminescent material can be evaluated for detecting the temperature-dependent phosphorescence characteristic.

If the light source is configured for continuous illuminating and exciting the luminescent material, the detector of the aerosol-generating device should be not sensitive to the excitation light in order to avoid interference and noise. The detector is a light sensor and is adapted to receive light emitted by the excited luminescent material. The detector must be sensitive to light emitted by the excited luminescent material. The detector may employ any standard photodiode, e.g. BPW34. The sensitivity of the detector may be a few degrees Celsius. The detector is able to determine a value that reflects a current temperature of the luminescent material and that changes according to a temperature change of the luminescent material. The detector enables a contactless temperature measurement regarding the aerosol-generating article.

The aerosol-generating device further comprises an electrical hardware. The electrical hardware is adapted to control heating by the heater. The heating is controlled based on the detected phosphorescence characteristic which has been detected by the detector and represents a current temperature of the luminescent material and is indicative of the current temperature of the aerosol-forming substrate.

Detecting the temperature of the aerosol-forming substrate by evaluating the temperature-dependent phosphorescence characteristic of a luminescent material enables a precise and reliable temperature detection and temperature control of an aerosol-forming substrate being heated by a heater of an aerosol-generating system.

Preferably, the electric hardware is configured to control heating based on the detected phosphorescence characteristic and a stored reference phosphorescence characteristic. The reference phosphorescence characteristic is stored within the aerosol-generating system, preferably within a memory of the aerosol-generating device. The reference phosphorescence characteristic may be stored in a look-up table within the aerosol-generating system. The reference phosphorescence characteristic may represent a reference phosphorescence property exhibited by the luminescent material when the aerosol-forming substrate has a suitable temperature for generating an aerosol. The electrical hardware may comprise an electronic control unit for processing the detected phosphorescence characteristic and the reference phosphorescence characteristic. The aerosol-generating device is preferably adapted for continuously controlling the heating by the heater based on continuously detected phosphorescence characteristic values for continuously keeping the temperature of the heated component or components of the aerosol-generating article within a desired temperature range.

The aerosol-generating system is preferably an electrically-operated aerosol-generating system having a power supply, such as a battery or an accumulator, for providing electrical energy to components of the aerosol-generating system. The power supply may provide electrical power to the electrical hardware for enabling control of the heating by the heater. Moreover, the power supply may provide electrical power to the heater so that the heater can convert supplied electric energy into heat energy.

The aerosol-generating article is preferably a smoking article.

The light source is preferably adapted to illuminate ultraviolet light for exciting the luminescent material. Optionally or alternatively, the light source may be adapted to illuminate visible light for exciting the luminescent material.

The detector is configured to detect light emitted by the excited luminescent material. The luminescent material is preferably adapted to emit, having been excited, invisible light. The invisible light is preferably infrared light. Preferably, the detector is configured to detect infrared light emitted by the excited luminescent material.

The aerosol-generating article may preferably comprise a luminescent material that emits infrared light after excitation. This luminescent material is preferably distributed within the aerosol-forming substrate, e.g. tobacco surrounded by a paper wrapper. As tobacco and paper is at least partially transparent even to infrared light of low intensity, the detector may advantageously be arranged outside the aerosol-generating article.

The aerosol-generating article may preferably comprise a luminescent material that emits visible light after excitation. This luminescent material may be deposited at a front surface of the aerosol-generating article. For using the aerosol-generating system, the front surface of the aerosol-generating article, e.g. a tobacco plug, is inserted first into the cavity-like support of the aerosol-generating device. Thus, undesired light can be prevented from reaching the detector. For an aerosol-generating article incorporating a susceptor for inductive heating, which extends up to the front surface of the aerosol-generating article, the susceptor temperature can be detected very accurately. Preferably, the susceptor end at the front surface is coated with the luminescent material. The luminescent material may also be deposited at one or more side surfaces of the aerosol-generating article. Several light sources and detectors may be provided in the aerosol-generating device adjacent to the one or more side surfaces of the aerosol-generating article.

The stored reference phosphorescence characteristic preferably takes into account a temperature difference between the aerosol-forming substrate and the luminescent material. Thus, the luminescent material may be arranged distant from the aerosol-forming substrate. The temperature differences typically occurring may be determined beforehand in a laboratory environment and may be stored in a look-up table of the electric hardware.

The stored reference phosphorescence characteristic comprises at least one threshold value for comparison with the detected phosphorescence characteristic. If the detected phosphorescence characteristic exceeds a single threshold value which indicates that temperature is too high, the heating will be stopped. If the detected phosphorescence characteristic does not exceed the single threshold value, the heating will be continued. Preferably, this kind of digital control of the heater includes a time-delay element for activating or deactivating the heater for at least a predetermined time period. This achieves a low implementation complexity. Using more than one threshold value enables adjusting the heating power of the heater gradually and thus enables a more precise temperature control.

The aerosol-generating device is preferably adapted to select and apply an individual reference phosphorescence characteristic for a respective aerosol-generating article from a set of aerosol-generating articles usable with the aerosol-generating system.

The detector of the aerosol-generating device is preferably adapted to identify the aerosol-generating article from a set of aerosol-generating articles usable with the aerosol-generating system based on a detected phosphorescence characteristic of the luminescent material.

The luminescent material has preferably an identifiable spectroscopic signature. The spectroscopic signature may be detected by the detector of the aerosol-generating device. The identifiable spectroscopic signature may be an identifiable spectroscopic signature in absorption. When the luminescent material is illuminated by a light source of the aerosol-generating device, the luminescent material will absorb a specific wavelength, or set of wavelengths, and the wavelengths of light subsequently received by a light sensor will therefore enable the aerosol-generating device to determine the luminescent material in dependence on the absent wavelengths.

The identifiable spectroscopic signature may be an identifiable spectroscopic signature in emission. The spectroscopic signature in emission may be identified when the luminescent material exhibits its phosphorescence property after excitation. A spectroscopic signature in emission may also be identified based on fluorescence of the luminescent material during excitation.

The detector of the aerosol-generating device is preferably adapted to identify the aerosol-generating article from a set of aerosol-generating articles usable with the aerosol-generating system based on an identifiable spectroscopic signature of the luminescent material. The spectroscopic signature may be either one or both of a spectroscopic signature exhibited by the luminescent material after excitation, i.e. phosphorescence, or a spectroscopic signature exhibited by the luminescent material during excitation, i.e. fluorescence.

The identifiable spectroscopic signature in absorption or emission of the luminescent material may be associated with the aerosol-generating article type or the aerosol-forming substrate type. Based on an identified spectroscopic signature an individual reference phosphorescence characteristic may be selected from a set of stored reference phosphorescence characteristics for controlling heating by the heater.

The luminescent material is preferably in powder form. Powder advantageously enables incorporation into component materials.

The luminescent material is preferably composed of at least one of a rare earth, an actinide oxide, a ceramic. The rare earth is preferably a lanthanide. Furthermore, any of $Y_3Al_5O_{12}$:Dy (YAG:Dy) and $La_2O_2S$:Eu may be used as luminescent material. Moreover, any one $YAlO_3$:Ce(YAP), ZnS:Ag, $(Sr,Mg)_2SiO_4$:Eu, $CdWO_4$, ZnO:Zn, ZnO:Ga, $Y_2O_2S$:Sm, $Mg_4FGeO_6$:Mn, $BaMg_2Al_{10}O_{17}$:Eu(BAM) may be used as luminescent material.

Preferably, the aerosol-generating device is configured for checking, based on the detected phosphorescence characteristic, whether an aerosol-generating article including the luminescent material is currently being received by the support. If the aerosol-generating article including the luminescent material is present in the aerosol-generating device, the phosphorescence characteristic of the luminescent material can be evaluated at room temperature or ambient temperature of the aerosol-generating device before operating the heater. Thus, the aerosol-generating system is able to check presence of an aerosol-generating article in the aerosol-generating article. In case of detected absence of an aerosol-generating article, the electric hardware will inhibit heating by the heater, in order to prevent a possible burning of components of the aerosol-generating device.

Preferably, the aerosol-generating device is configured for checking, based on the detected phosphorescence characteristic, whether an aerosol-generating article including the luminescent material currently being received by the support is valid for use with the aerosol-generating device. The phosphorescence characteristic of the luminescent material can be evaluated at room temperature or ambient temperature of the aerosol-generating device. If the detected phosphorescence characteristic deviates from a required or expected phosphorescence characteristic, the electric hardware will decide that the received aerosol-generating article is not valid for use and will inhibit further operation, in particular heating by the heater, of the aerosol-generating system. This enables an anti-counterfeiting solution.

The heater of the aerosol-generating system may comprise one or more components which are arranged either within the aerosol-generating device or the aerosol-generating article, or within both of the aerosol-generating device and the aerosol-generating article.

The aerosol-generating article may be between about 30 millimeters and about 120 mm in length, for example about 45 millimeters in length. The aerosol-generating article may be between about 4 millimeters and about 15 millimeters in diameter, for example about 7.2 mm. The aerosol-forming substrate may be between about 3 millimeters and about 30 millimeters in length.

The aerosol-forming substrate may preferably be a solid aerosol-forming substrate. The aerosol-forming substrate preferably comprises a tobacco-containing material containing volatile tobacco flavour compounds which are released from the substrate upon heating. Alternatively, the aerosol-forming substrate may comprise a non-tobacco material such as those used in the devices of EP-A-1 750 788 and EP-A-1 439 876. Preferably, the aerosol-forming substrate further comprises an aerosol former. Examples of suitable aerosol formers are glycerine and propylene glycol. Additional examples of potentially suitable aerosol formers are described in EP-A-0 277 519 and U.S. Pat. No. 5,396,911. The aerosol-forming substrate may be a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco. Optionally, the solid substrate may contain additional tobacco or non-tobacco volatile flavour compounds, to be released upon heating of the substrate.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. Nos. 5,505,214, 5,591,368 and 5,388,594, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a non-uniform flavour delivery during use. Alternatively, the carrier may be a non-woven fabric or fibre bundle into which tobacco components have been incorporated, such as that described in EP-A-0 857 431. The non-woven fabric or fibre bundle may comprise, for example, carbon fibres, natural cellulose fibres, or cellulose derivative fibres.

The aerosol-forming substrate may preferably be a liquid aerosol-forming substrate. The aerosol-forming substrate may be a liquid substrate and the aerosol-generating article may comprise means for retaining the liquid substrate. For example, the aerosol-generating article may comprise a container, such as that described in EP-A-0 893 071. Alternatively or in addition, the aerosol-generating article may comprise a porous carrier material, into which the liquid substrate may be absorbed, as described in WO-A-2007/024130, WO-A-2007/066374, EP-A-1 736 062, WO-A-2007/131449 and WO-A-2007/131450. The aerosol-forming substrate may alternatively be any other sort of substrate, for example, a gas substrate, or any combination of the various types of substrate. The luminescent material may be incorporated into the means for retaining the liquid substrate, for example within the material forming the container for retaining the liquid substrate. Alternatively or in addition, where present, the luminescent material may be incorporated into the porous carrier material.

The aerosol-generating article may preferably be configured as a heat stick. The heat stick comprises a hollow wrapper filled with the aerosol-forming substrate. The wrapper may be tubular. For inductive heating, a metal blade or sheet may be included as a susceptor in the heat stick. Preferably, the susceptor is surrounded by the aerosol-forming substrate, e.g. tobacco, and is visible at one end surface of the heat stick. Preferably, the susceptor is at least at its visible (when not being received by the aerosol-generating device) end coated, sprayed or deposited with the luminescent material.

The heater of the aerosol-generating system may be configured as an inductive heater. The inductive heater may comprise an inductive heating element and a susceptor. Preferably, the inductive heating element is provided without physical contact to the susceptor. The inductive heating element is adapted for emitting a time-varying electromagnetic field. Preferably, the inductive heating element is part of the aerosol-generating device. Preferably, the susceptor is part of the aerosol-generating article. The susceptor may be configured as at least one metal blade or sheet, at least partially surrounded by the aerosol-forming substrate. The inductive heating element is arranged and adapted to apply a changing electromagnetic field, e.g. radiofrequency or microwave radiation, to the susceptor. The susceptor is adapted to absorb at least a part of the electromagnetic energy of the electromagnetic field from the inductive heating element and to convert the electromagnetic energy into heat energy. Thus, the susceptor is heated by receiving electromagnetic energy from the inductive heating element, and the heated susceptor heats the aerosol-forming substrate and the luminescent material by thermal conduction.

The heater may comprise an infrared heating element.

The heater may comprise a resistive heating element. The resistive heating element may be configured as a mesh heating element. The mesh heating element comprises a plurality of wires which can be made of a single type of fibers, such as resistive fibers, as well as a plurality of types of fibers, including capillary fibers and conductive fibers. Preferably, the mesh heating element comprises a plurality of electrically conductive filaments. The plurality of electrically conductive filaments configures a mesh of the mesh heating element. The mesh is heated by applying electric power to the plurality of electrically conductive filaments. The electrically conductive filaments may comprise any suitable electrically conductive material.

The heater may comprise a fuel gas driven heating element. Supply of the fuel gas to the heating element may be adjusted by the electrical hardware.

The at least one heating element may comprise a single heating element. Alternatively, the at least one heating element may comprise more than one heating element. The heating element or heating elements may be arranged appropriately so as to most effectively heat the aerosol-forming substrate in an aerosol-generating article.

The at least one heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heating elements are disclosed in U.S. Pat. No. 5,498,855, WO-A-03/095688 and U.S. Pat. No. 5,514,630.

The at least one heating element may comprise an infrared heating element, a photonic source such as, for example, those described in U.S. Pat. No. 5,934,289, or an inductive heating element, such as, for example, those described in U.S. Pat. No. 5,613,505.

The at least one heating element may take any suitable form. For example, the at least one heating element may take the form of a heating blade, such as those described in U.S. Pat. Nos. 5,388,594, 5,591,368 and 5,505,214. Alternatively, the at least one heating element may take the form of a casing or substrate having different electro-conductive portions, as described in EP-A-1 128 741, or an electrically resistive metallic tube, as described in WO-A-2007/066374. Alternatively, one or more heating needles or rods that run through the centre of the aerosol-forming substrate, as described in KR-A-100636287 and JP-A-2006320286, may also be suitable. Alternatively, the at least one heating element may be a disk (end) heater or a combination of a disk heater with heating needles or rods. Other alternatives include a heating wire or filament, for example a Ni—Cr, platinum, tungsten or alloy wire, such as those described in EP-A-1 736 065, or a heating plate.

The at least one heating element may heat the aerosol-forming substrate by means of conduction. The heating element may be at least partially in contact with the substrate, or the carrier on which the substrate is deposited. Alternatively, the heat from the heating element may be conducted to the substrate by means of a heat conductive element. Alternatively, the at least one heating element may transfer heat to the incoming ambient air that is drawn through the electrically operated aerosol-generating system during use, which in turn heats the aerosol-forming substrate by convection. The ambient air may be heated before passing through the aerosol-forming substrate, as described in WO-A-2007/066374.

The aerosol-generating device is preferably a handheld aerosol-generating device that is comfortable for a user to hold between the fingers of a single hand. The aerosol-generating device may be substantially cylindrical in shape. Preferably, the electrically heated smoking system is reusable. Preferably, each aerosol-generating article is disposable.

During operation, the aerosol-generating article, and its aerosol-forming substrate, may be completely received in the cavity and thus completely contained within the electrically operated aerosol-generating system. In that case, a user may puff on a mouthpiece of the electrically operated aerosol-generating system. Alternatively, during operation, the aerosol-generating article may be partially received in the cavity such that the aerosol-forming substrate is fully or partially contained within the electrically operated aerosol-generating system. In that case, a user may puff directly on the article or on a mouthpiece of the electrically operated aerosol-generating system.

Preferably, the electrically operated aerosol-generating system is arranged to initiate, when the detector detects the aerosol-generating article in the cavity. The system may be initiated when the electrical hardware connects the power supply and the at least one heating element. Alternatively, or in addition, the system may be initiated when the system switches from a standby mode to an active mode. Alternatively, or in addition, the system may further comprise a switch and may be initiated when the switch is turned on, such that the at least one heating element is heated only when an aerosol-generating article is detected in the cavity. Initiation of the system may additionally or alternatively comprise other steps.

Preferably, the electrical hardware comprises a programmable controller, for example, a microcontroller, for controlling operation of the heater. In one embodiment, the controller may be programmable by software. Alternatively, the controller may comprise application specific hardware, such as an Application-Specific Integrated-Circuit (ASIC), which may be programmable by customizing the logic blocks within the hardware for a particular application. Preferably, the electrical hardware comprises a processor. Additionally, the electrical hardware may comprise memory for storing heating preferences for particular articles, user preferences, user smoking habits or other information. Preferably, the information stored can be updated and replaced depending on the particular articles usable with the smoking system. Also, the information may be downloaded from the system.

In one exemplary embodiment, the electrical hardware comprises a sensor to detect air flow indicative of a user taking a puff. The sensor may comprise a thermistor. The sensor may be an electro-mechanical device. Alternatively, the sensor may be any of: a mechanical device, an optical device, an opto-mechanical device and a micro electro mechanical systems (MEMS) based sensor. In that case, the electrical hardware may be arranged to provide an electric current pulse to the at least one heating element when the sensor senses a user taking a puff. In an alternative embodiment, the system further comprises a manually operable switch, for a user to initiate a puff.

Preferably, the electrical hardware is arranged to establish a heating protocol for the at least one heating element based on the particular article identified by the detector.

The heating protocol may comprise one or more of: a maximum operating temperature for the heating element, a maximum heating time per puff, a minimum time between puffs, a maximum number of puffs per article and a maximum total heating time for the article. Establishing a heating protocol tailored to the particular article is advantageous because the aerosol-forming substrates in particular articles may require, or provide an improved user experience with, particular heating conditions. As already mentioned, preferably, the electrical hardware is programmable, in which case various heating protocols may be stored and updated.

According to a second aspect of the present invention, there is provided an aerosol-generating article including at least one component incorporating an aerosol-forming substrate and a luminescent material having a temperature-dependent phosphorescence characteristic. The aerosol-generating article is adapted for use in the aerosol-generating system according to the first aspect of the invention.

According to a third aspect of the present invention, there is provided a method for operating and controlling an aerosol-generating system according to the first aspect of the invention. The method comprises the steps of receiving the aerosol-generating article of the aerosol-generating system at least partially in the support of the aerosol-generating device of the aerosol-generating system; heating the luminescent material and the aerosol-forming substrate of the received aerosol-generating article by the heater of the aerosol-generating system; illuminating and exciting the luminescent material by the light source of the aerosol-generating device; detecting, by the detector of the aerosol-generating device, a temperature-dependent phosphorescence characteristic of the excited luminescent material by detecting light emitted by the excited luminescent material; and controlling, by the electrical hardware of the aerosol-generating device, the heating based on the detected phosphorescence characteristic.

The step of detecting preferably includes identifying the aerosol-generating article from a set of aerosol-generating articles usable with the aerosol-generating system based on a detected phosphorescence characteristic of the luminescent material.

The step of detecting preferably includes identifying the aerosol-generating article from a set of aerosol-generating articles usable with the aerosol-generating system based on an identifiable spectroscopic signature of the luminescent material.

The step of controlling preferably includes taking into account a temperature difference between the aerosol-forming substrate and the luminescent material.

Preferably, the method further includes a step of checking, preferably at room temperature, based on the detected phosphorescence characteristic, whether an aerosol-generating article is currently being received by the support and whether a received aerosol-generating article is valid for use with the aerosol-generating device.

Any feature in one aspect of the invention may be applied to other aspects of the invention, in any appropriate combination. In particular, method aspects may be applied to apparatus aspects, and vice versa. Furthermore, any, some or all features in one aspect can be applied to any, some or all features in any other aspect, in any appropriate combination. It should also be appreciated that particular combinations of the various features described and defined in any aspects of the invention can be implemented or supplied or used independently.

The invention will be further described, by way of example only, with reference to the accompanying drawings in which:

FIG. 1 shows an aerosol-generating article according to the invention;

FIG. 2 shows an aerosol-generating system according to the invention;

Figure 5:
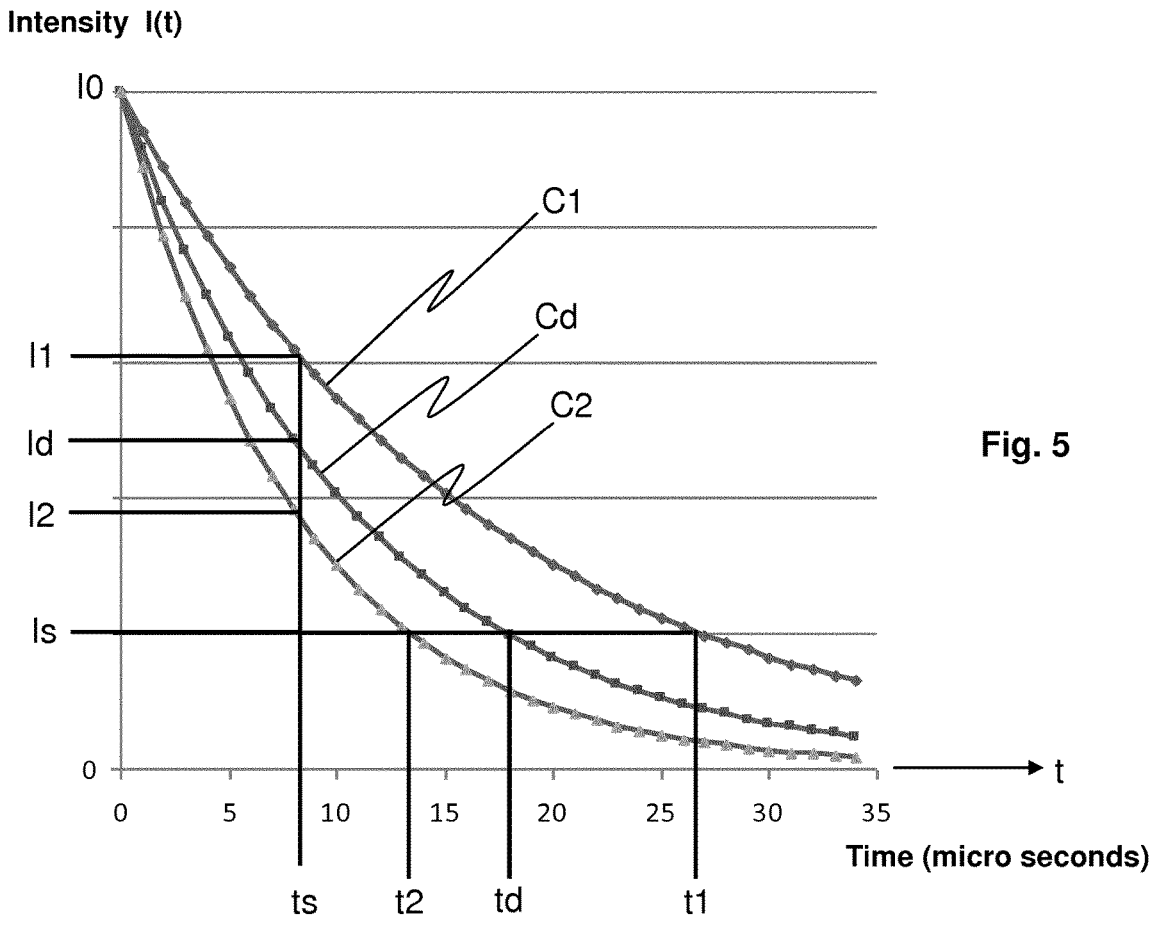
Figure 6:
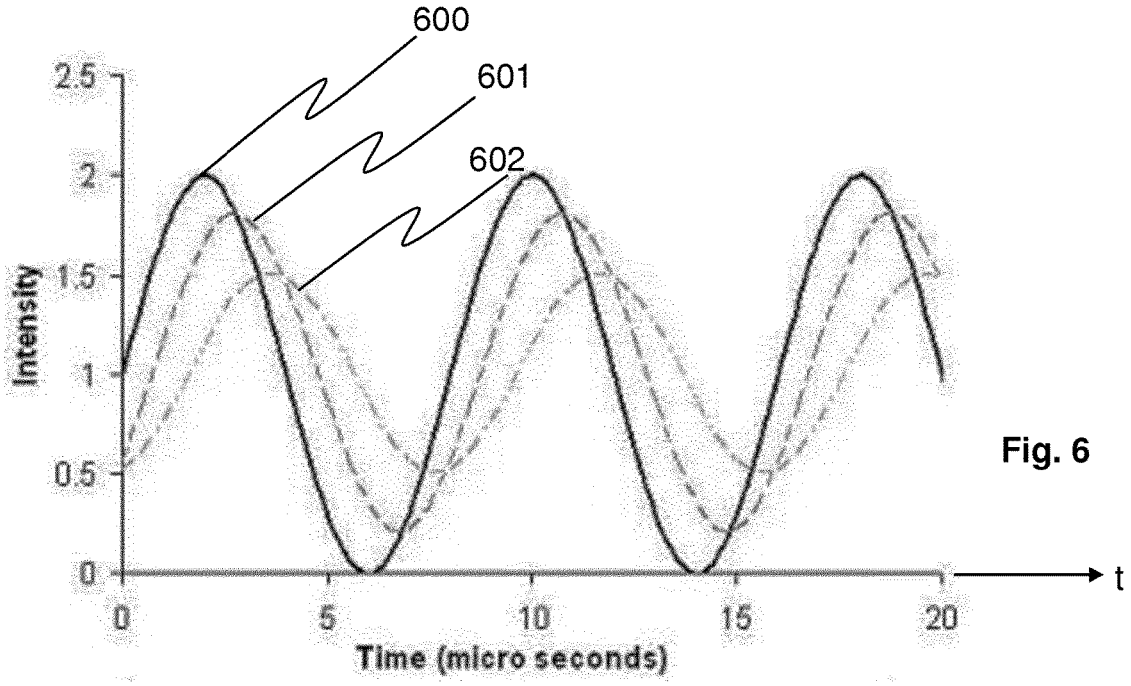

FIG. 5 shows curves of temperature-dependent luminescence decay of a luminescent material over time after excitation, and illustrates implementations for detecting a phosphorescence characteristic in terms of a luminescence decay rate and controlling heating based on a reference phosphorescence characteristic in terms of a reference luminescence decay characteristic; and FIG. 6 illustrates a phase-lag based detection of temperature-dependent phosphorescence characteristics in case of illuminating and exciting the luminescent material with an excitation light of sinusoidal pulse shape.

FIG. 1 shows an aerosol-generating article 100. The article 100 comprises an aerosol-forming substrate 102, a hollow tubular transfer element 104, a mouthpiece 106, and an outer wrapper 108. The outer wrapper 108 comprises a luminescent material (represented by the dots) which emits light after excitation. The luminescent material is incorporated in the wrapper during manufacturing of the material.

The wrapper material in this example is manufactured by incorporating the luminescent material, in powder form, to the wrapper paper material slurry, before the slurry is formed into paper and dried. Alternatively, the luminescent material may be applied to the wrapper material in a solution by spraying, printing, painting or the like.

The aerosol-generating article for use in an electrically operated aerosol-generating device as described below incorporates the luminescent material within the wrapper. The luminescent material has an identifiable spectroscopic signature.

The use of the luminescent material incorporated within the material of the wrapper allows contactless detection of the temperature of the aerosol-generating substrate.

FIG. 2 shows a perspective view of one exemplary embodiment of an electrically operated aerosol-generating system 200 according to the invention. The electrically operated aerosol-generating system 200 is a smoking system comprising a housing 202 having a front housing portion 204 and a rear housing portion 206. The front housing portion 204 includes a front end portion 208 having a cavity-like support 210 capable of receiving an aerosol-generating article, such as a smoking article. In FIG. 2, the smoking system 200 is shown with a smoking article in the form of cigarette 100. In this embodiment, the front housing portion 204 also includes a display 212. The display 212 is not shown in detail, but it may comprise any suitable form of display, for example a liquid crystal display (LCD), a light-emitting diode (LED) display or a plasma display panel. In addition, the display may be arranged to show any required information, for example relating to smoking article or cleaning article.

The electrically heated smoking system 200 also includes a detecting unit (not shown in FIG. 2) positioned in or adjacent the support 210. The detecting unit comprising the light source and the detector is able to detect the presence of an aerosol-generating article 100 in the support and is also able to detect a temperature-dependent phosphorescence characteristic as a luminescence decay rate of the luminescent material incorporated in the aerosol-generating article 100. The detector is adapted to detect the presence of the aerosol-generating article 100 in the support by detecting the phosphorescence characteristic of luminescent material included in the aerosol-generating article 100 at room temperature. A light source for illuminating and exciting the luminescent material is provided. The detector is a light sensor for receiving and measuring light emitted by the luminescent material after excitation.

Figure 3:
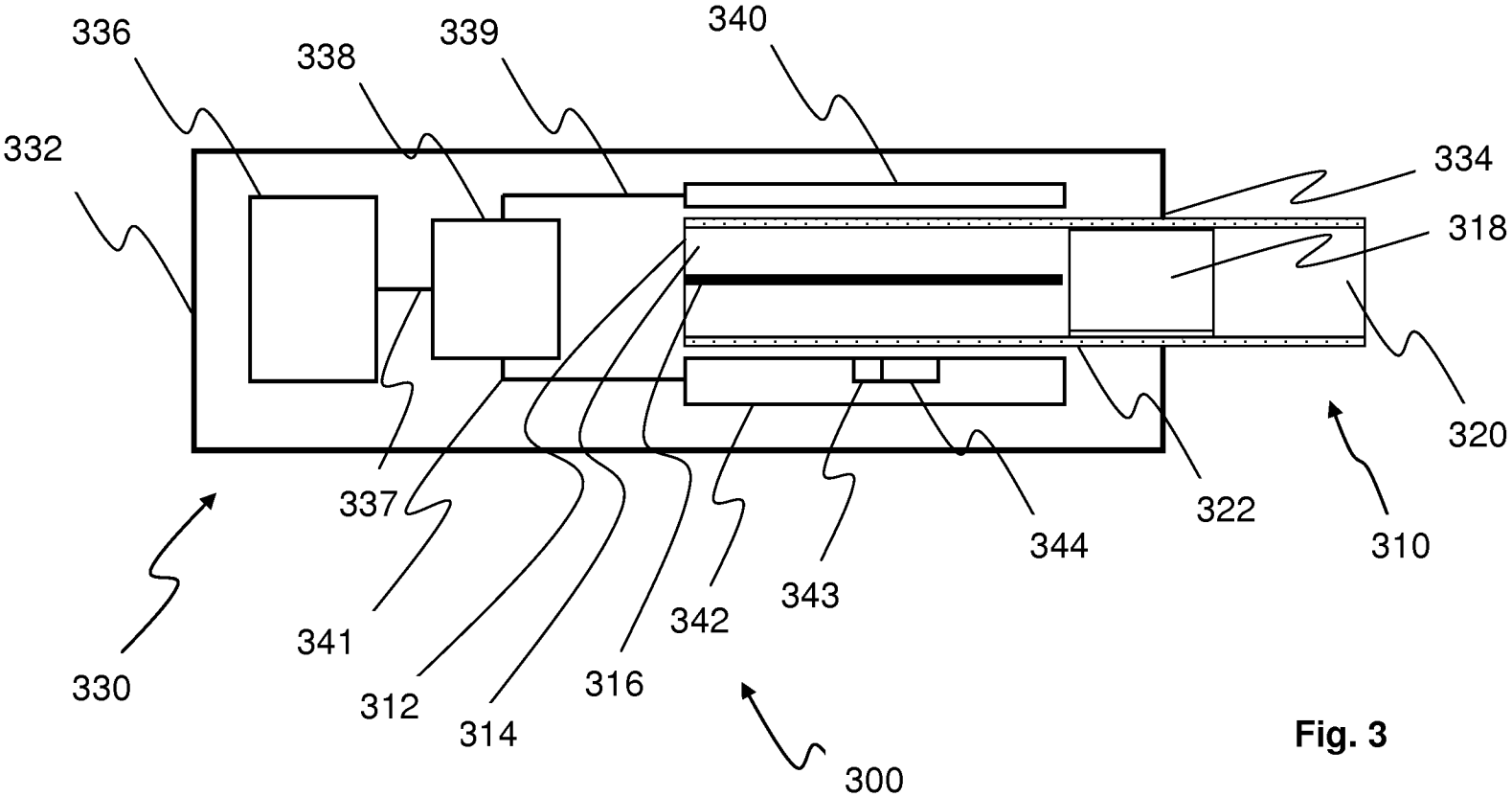
FIG. 3 shows a schematic representation of an alternative aerosol-generating system according to the invention.

FIG. 3 shows a schematic representation of a further exemplary embodiment of an aerosol-generating system 300 according to the invention. The aerosol-generating system comprises an aerosol-generating article 310 and an aerosol-generating device 330. For operating the aerosol-generating system 300, the aerosol-generating article 310 has to be received by a cavity of the aerosol-generating device 330. A front surface 312 of one end of the aerosol-generating article 310 is inserted into the cavity first. The other end of the aerosol-generating article 310 is configured as a mouth piece 320.

The aerosol-generating system 300 comprises a heater configured as an inductive heater. The inductive heater comprises an inductive heating element 340 and a susceptor 316 arranged distant to each other. The inductive heating element 340 is provided as a part of the aerosol-generating device 330. The susceptor 316 is provided as a part of the aerosol-generating article 310. The inductive heating element 340 is adapted to apply a time-varying electromagnetic field to the susceptor 316. The susceptor 316 is adapted to be heated by being exposed to the electromagnetic field emitted by the inductive heating element 340.

The aerosol-generating article 310 comprises, similar to the aerosol-generating article 100 shown in FIG. 1, an aerosol-forming substrate 314 (e.g. tobacco), a hollow tubular transfer element 318, the mouthpiece 320, and an outer wrapper 322. The outer wrapper 322 comprises a luminescent material (represented by the dots) which emits light after excitation.

The luminescent material is incorporated in the wrapper 322 during manufacturing of the material. As mentioned above, the aerosol-generating article 310 comprises the susceptor 316. The susceptor 316 is configured as a metal blade or metal sheet surrounded by the aerosol-forming substrate 314. The susceptor 316 is at least partially enclosed by the aerosol-forming substrate 314. The aerosol-forming substrate 314 and the luminescent material of the outer wrapper 322 are arranged to receive heat energy from the susceptor 316 by thermal conduction.

The aerosol-generating device 330 is provided with a support, configured as a cavity, for receiving the aerosol-generating article 310. The cavity of the aerosol-generating device 330 is accessible through an opening 334 of a housing 332 of the aerosol-generating device 330 and is configured for holding the aerosol-generating article 310.

Moreover, the aerosol-generating device 330 comprises a power supply 336, such as a battery, electric hardware configured as a control circuitry 338, an inductive heating element 340, and a detecting unit 342. The power supply 336 is adapted to provide electric energy to the control circuitry 338 via a power line 337. The control circuitry 338 is adapted to control electrical energy supply to the inductive heating element 340 via line 339 in order to control the heating operation of the inductive heating element 340. The inductive heating element 340 is arranged adjacent to the aerosol-generating article 310 such that electromagnet radiation energy can be transmitted from the inductive heating element 340 to the susceptor 316 without physical contact between them. When the aerosol-forming substrate is heated to a temperature within a desired temperature range, an aerosol is provided to a user drawing or sucking at the mouthpiece 320.

The detecting unit 342 comprises a light source 343 and a light sensor 344. The light source 343 is adapted to illuminate light onto the wrapper 322 and to thereby excite the luminescent material incorporated in the wrapper 322. The light sensor 344 is adapted to detect light emitted by the excited luminescent material incorporated in the wrapper 322. In this embodiment, the light source 343 and the light sensor 344 may be alternately operated. In one embodiment the luminescent material incorporated into the wrapper 322 is adapted to emit infrared light after excitation. The light sensor 344 is adapted to detect the infrared light emitted by the luminescent material. In another embodiment the luminescent material incorporated into the wrapper 322 is adapted to emit visible light after excitation. The light sensor 344 is adapted to detect the visible light emitted by the luminescent material.

The detection result of the light sensor 344 is reported to the control circuitry 338 via a connection line 341. The control circuitry 338 may schedule the operation of the light source 343 and the light sensor 344. The control circuitry 338 is adapted to derive an information on the current temperature of the aerosol-forming substrate 314 from a detection result based on a reference phosphorescence characteristic, i.e. a reference luminescence decay characteristic, stored in the control circuitry 338. For deriving the current temperature of the aerosol-forming substrate 314 based on the light emitted from the excited luminescent material, the control circuit is able to take into account a system-inherent difference between the current temperatures of the aerosol-forming substrate 314 and the luminescent material incorporated in the wrapper 322.

Figure 4:
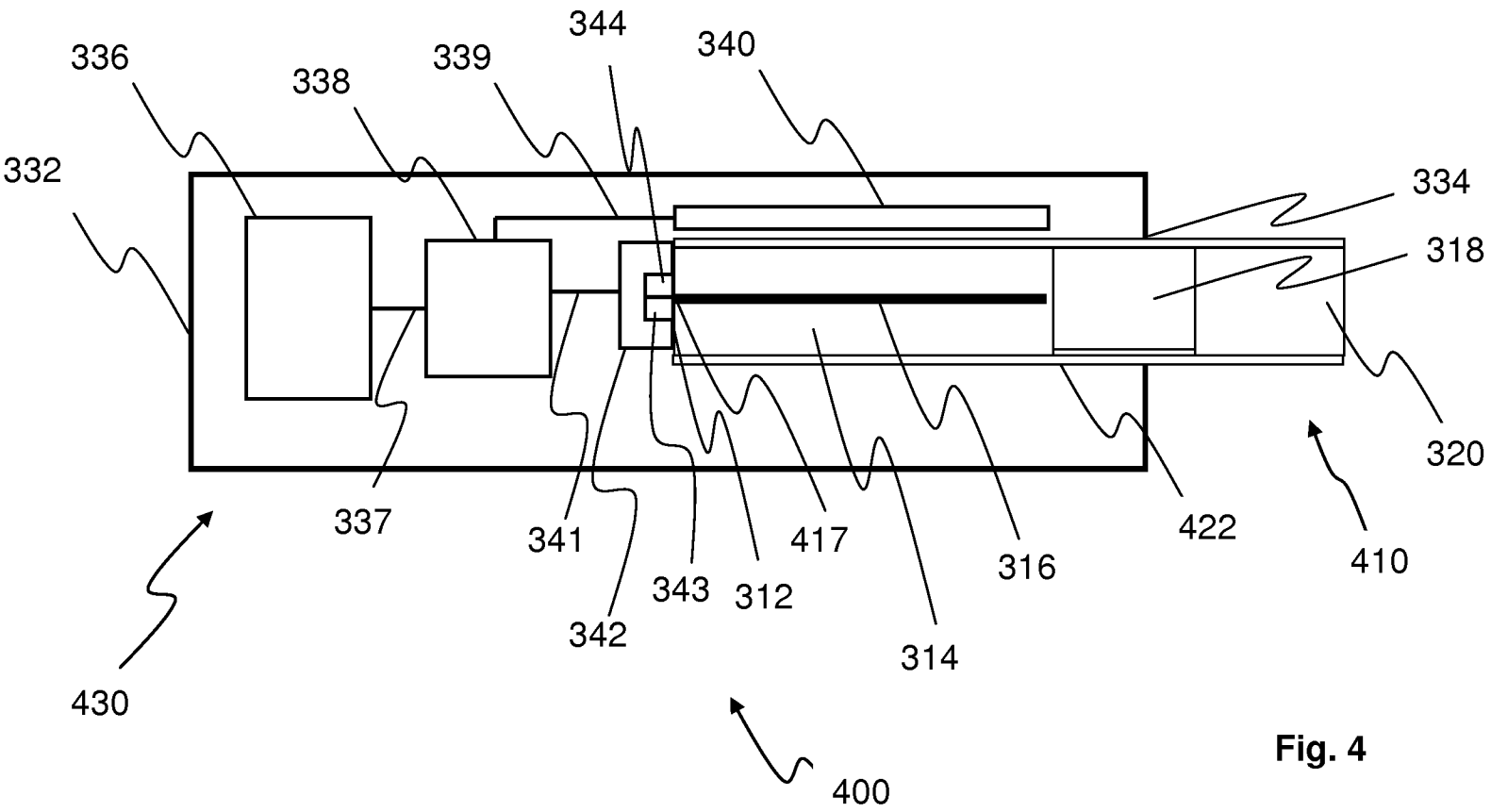
FIG. 4 shows a schematic representation of a further alternative aerosol-generating system according to the invention.

FIG. 4 shows a schematic representation of a further aerosol-generating system 400. The system shown in FIG. 4 is similar to that shown in FIG. 3. Therefore, the same reference signs in FIG. 3 and FIG. 4 denote the same or similar components. The aerosol-generating system 400 differs from the aerosol-generating system 300 mainly in the arrangement position of the luminescent material and of the detecting unit. In aerosol-generating system 400, the luminescent material is not necessarily incorporated in the wrapper 422 (compared to wrapper 322 of FIG. 3). In aerosol-generating system 400, the luminescent material is coated, sprayed or deposited onto the susceptor 316. The susceptor 316 extends up to the front surface 312 of the aerosol-generating article 410. The end 417 of the susceptor 316 at the front surface 312 is visible, when the aerosol-generating article 410 is not received by the aerosol-generating device 430. The detecting unit 342 of aerosol-generating system 400 is the same as the one of aerosol-generating system 300. However, the detecting unit 342 of aerosol-generating system 400 is arranged facing the front surface 312 of the aerosol-generating article 410. In this mounting position the light source 343 of the detecting unit 342 is adapted to illuminate the end 417 of the susceptor 316 and to thereby excite the luminescent material deposited at the end 417 of the susceptor 316. The detector 344 of the detecting unit 342 detects the light emitted from the excited luminescent material at the end 417. The luminescent material preferably emits visible light after excitation.

FIG. 5 shows curves of temperature-dependent luminescence decay of a luminescent material over time after excitation, and illustrates implementations for detecting a phosphorescence characteristic in terms of a luminescence decay rate and controlling heating based on a reference phosphorescence characteristic in terms of a reference luminescence decay characteristic. Curves C1, Cd and C2 are curves of a temperature-dependent (each curve represents decay during an individual constant temperature) luminescence decay of a same luminescent material over time t, after excitation has been stopped at time t=0. All curves represent an exponential luminescence decay where the current intensity I(t) of the light emitted by a luminescent material after ending excitation at time t=0 follows the expression $I(t)=10\cdot\exp(-t/tau)$, wherein tau is the temperature-dependent amount of time required for the brightness of the emitted light to decrease to 1/e of its original value I0. Curve C1 represents the slowest luminescence decay and refers to a luminescence decay at a low temperature. Curve C2 represents the fastest luminescence decay and refers to a luminescence decay at a high temperature. Curve Cd represents a medium luminescence decay and refers to a luminescence decay at a medium temperature.

If the presented aerosol-generating system shall keep the temperature of the aerosol-forming substrate within a suitable temperature range, C1 and C2 may set up a reference luminescence decay characteristic, i.e. a reference phosphorescence characteristic, as a basis for controlling heating by the heater. In this case, curve C1 is associated to the lowest desired temperature, and curve C2 is associated to the highest desired temperature. Such a reference luminescence decay characteristic allows a simple threshold value based implementation. The threshold values are derived from the minimum temperature curve C1 and the maximum temperature curve C2 as follows. Curves C1 and C2 have been determined before in a calibration environment and may take into account a system-inherent difference between the temperatures of the aerosol-forming substrate and the luminescent material.

According to one alternative, the detector may measure an intensity Id of the light emitted by the excited luminescent material after a predetermined amount of time ts has been elapsed since end of excitation (t=0). The current temperature is in the suitable temperature range, if measured intensity Id is lower than I1=C1(ts) (i.e. the intensity corresponding to amount of time ts according to C1) and higher than I2=C2(ts) (i.e. the intensity corresponding to amount of time ts according to C2). Threshold values I1 and I2 have been stored in the electric hardware in advance.

According to another alternative, the detector may measure an amount of time td which corresponds to an intensity decay from I0 to a predetermined intensity Is. The current temperature is in the suitable range, if measured amount of time td is lower than t1=C1(Is) (i.e. the amount of time corresponding to intensity Is according to C1) and higher than t2=C2(Is) (i.e. the amount of time corresponding to intensity Is according to C2). Threshold values t1 and t2 have been stored in the electric hardware in advance.

If the measured intensity Id or the measured amount of time td is lower than the corresponding value I2 and t2, respectively, the electric hardware interrupts the heating by the heater. If the measured intensity Id or the measured amount of time td exceeds the corresponding value I1 and t1, respectively, the electric hardware (re)activates the heating by the heater.

Measuring the above mentioned intensity Id or the amount of time td corresponds to detecting the temperature-dependent phosphorescence characteristic in terms of the luminance decay rate. The predetermined time td or the amount of time for reaching predetermined intensity Id is preferably within a range from 10 nanoseconds to 10 milliseconds. Please note that the numbers and proportions of FIG. 5 are intended only for illustrative reasons and shall not be construed as limiting the scope of the present invention.

FIG. 6 illustrates detection of a temperature-dependent phosphorescence characteristic in case of illuminating and exciting the luminescent material with a continuous excitation light of sinusoidal shape. This kind of detecting the temperature-dependent phosphorescence characteristic may be used with the embodiments of the aerosol-generating systems 300 and 400, shown in FIGS. 3 and 4, respectively, having a light source configured for illuminating and exciting the luminescent material continuously with an excitation light of varying intensity. Curve 600 illustrates the continuously varied intensity of the excitation light from the light source of the aerosol-generating device according to one of the above embodiments over time. Curves 601 and 602 show respective intensities of light emitted from the luminescent material excited by the light according to curve 600 for different temperatures of the luminescent material. The intensity of the light emitted by the luminescent material, as illustrated by either one of curves 601 and 602, can be detected simultaneously with illuminating the luminescent material with the sinusoidal waveform according to curve 600. Curve 601 represents a phosphorescence characteristic of the luminescent material having a higher temperature compared to curve 602. The temperature of the luminescent material can be detected based on determining a phase lag between curve 600 of the sinusoidal excitation light and anyone of curves 601, 602 of light emitted by the excited luminescent material. The phase lag corresponds to the lifetime of phosphorescence. For the same luminescence material, a small phase lag corresponds to a high temperature of the luminescence material, and a large phase lag corresponds to a low temperature luminescence material.

The exemplary embodiments described above illustrate but are not limiting. In view of the above-discussed exemplary embodiments, other embodiments consistent with the above exemplary embodiments will now be apparent to anyone of ordinary skill in the art.

The invention claimed is:

1. An aerosol-generating system, comprising:

an aerosol-generating article including at least one component incorporating an aerosol-forming substrate;

a luminescent material having a temperature-dependent phosphorescence characteristic;

a heater configured to heat the luminescent material and the at least one component incorporating the aerosol-forming substrate; and an aerosol-generating device comprising:

a support configured to at least partially receive the aerosol-generating article, a light source configured to illuminate and to excite the luminescent material, a detector configured to detect a temperature-dependent phosphorescence characteristic of the excited luminescent material, and electrical hardware configured to control heating by the heater based on the detected temperature-dependent phosphorescence characteristic.

2. The aerosol-generating system according to claim 1, wherein the electrical hardware is further configured to control heating based on the detected temperature-dependent phosphorescence characteristic and a stored reference phosphorescence characteristic.

3. The aerosol-generating system according to claim 2, wherein the stored reference phosphorescence characteristic takes into account a temperature difference between the aerosol-forming substrate and the luminescent material.

4. The aerosol-generating system according to claim 2, wherein the stored reference phosphorescence characteristic comprises at least one threshold value for comparison with the detected temperature-dependent phosphorescence characteristic.

5. The aerosol-generating system according to claim 2, wherein the aerosol-generating device is configured to select and apply an individual reference phosphorescence characteristic for a respective aerosol-generating article from a set of aerosol-generating articles usable with the aerosol-generating system.

6. The aerosol-generating system according to claim 1, wherein the detector is further configured to identify the aerosol-generating article from a set of aerosol-generating articles usable with the aerosol-generating system based on the detected temperature-dependent phosphorescence characteristic of the luminescent material.

7. The aerosol-generating system according to claim 1, wherein the luminescent material has an identifiable spectroscopic signature.

8. The aerosol-generating system according to claim 1, wherein the detector is further configured to identify the aerosol-generating article from a set of aerosol-generating articles usable with the aerosol-generating system based on an identifiable spectroscopic signature of the luminescent material.

9. The aerosol-generating system according to claim 1, wherein the aerosol-generating device is configured to check, based on the detected temperature-dependent phosphorescence characteristic, whether the aerosol-generating article is currently being received by the support and whether a received aerosol-generating article is valid for use with the aerosol-generating device.

10. The aerosol-generating system according to claim 9, wherein the aerosol-generating device is further configured to check while at room temperature.

11. The aerosol-generating system according to claim 1, wherein the luminescent material is incorporated in the aerosol-generating article or in the aerosol-generating device.

12. The aerosol-generating system according to claim 1, wherein the light source is further configured to illuminate and to excite the luminescent material with ultraviolet light, or the luminescent material is configured to emit infrared light upon being excited.

13. A method for controlling an aerosol-generating system according to claim 1, the method comprising:

receiving the aerosol-generating article at least partially in the support of the aerosol-generating device;

heating the luminescent material and the aerosol-forming substrate of the received aerosol-generating article by the heater;

illuminating and exciting the luminescent material by the light source of the aerosol-generating device;

detecting, by the detector of the aerosol-generating device, a temperature-dependent phosphorescence characteristic of the excited luminescent material; and controlling, by the electrical hardware of the aerosol-generating device, the heating based on the detected temperature-dependent phosphorescence characteristic.

14. The method according to claim 13, wherein the detecting includes identifying the aerosol-generating article from a set of aerosol-generating articles usable with the aerosol-generating system based on the detected temperature-dependent phosphorescence characteristic or on an identifiable spectroscopic signature of the luminescent material.

15. The method according to claim 13, wherein the controlling includes taking into account a temperature difference between the aerosol-forming substrate and the luminescent material.

* * * * *